US006364148B1

(12) United States Patent
Neilson et al.

(10) Patent No.: US 6,364,148 B1
(45) Date of Patent: Apr. 2, 2002

(54) STORAGE POD FOR UNDERGROUND MINING MACHINE

(75) Inventors: Brad Neilson, New South Wales (AU); John R. Frederick, Polk, PA (US)

(73) Assignee: Joy MM Delaware, Inc., Wilmington, DE (US)

( * ) Notice: Subject to any disclaimer, the term of this patent is extended or adjusted under 35 U.S.C. 154(b) by 0 days.

(21) Appl. No.: 09/600,210

(22) PCT Filed: Jan. 12, 1999

(86) PCT No.: PCT/AU99/00012

§ 371 Date: Jul. 12, 2000

§ 102(e) Date: Jul. 12, 2000

(87) PCT Pub. No.: WO99/36231

PCT Pub. Date: Jul. 22, 1999

(30) Foreign Application Priority Data

Jan. 16, 1998 (AU) ..... PP1364
Jan. 19, 1998 (AU) ..... PP1399

(51) Int. Cl.[7] ..... B25H 5/00

(52) U.S. Cl. ..... 220/553; 220/1.5; 220/503; 220/554

(58) Field of Search ..... 220/553, 554, 220/1.5, 4.27, 503, 909

(56) References Cited

U.S. PATENT DOCUMENTS 1,660,521 A * 2/1928 Nordgren
3,196,229 A * 7/1965 Glass ..... 220/4.27 X
4,390,217 A * 6/1983 Wagner ..... 220/503 X
4,893,722 A * 1/1990 Jones ..... 220/503
4,919,290 A * 4/1990 Wadel ..... 220/503
6,332,554 B1 * 12/2001 McCarthy ..... 220/503 X

FOREIGN PATENT DOCUMENTS

GB 2245255 * 1/1992

* cited by examiner

*Primary Examiner*—Steven Pollard
(74) *Attorney, Agent, or Firm*—James Earl Lowe, Jr.

(57) ABSTRACT

The present invention provides a storage pod for storing equipment and parts for use in underground mining operations, said storage pod being self supporting and removable from a transport or operational vehicle whereupon said pod is carried in use, said pod comprising a generally rectilinear body which forms an open topped upper compartment having a front wall, a rear wall, side walls and a floor, and a lower compartment located below said floor, said lower compartment being divided into a series of elongated storage slots, said slots being accessible from the front and/or rear of the pod. The invention also provides an underground mining machine in assembly with a pod of the type described above, the vehicle and pod having cooperating locking formations thereon for releasably locking the pod the vehicle for the duration of a mining operation and adapted to allow removal of the pod from the vehicle and replacement thereof with another pod as and when required in use.

17 Claims, 10 Drawing Sheets

STORAGE POD FOR UNDERGROUND MINING MACHINE

FIELD OF THE INVENTION

This invention relates to a transportable storage pod for storing mining equipment and consumable items used in underground mining operations. The invention will be particularly described with reference to a machine used for roof bolting but it is to be understood that the invention may be used in other mining operations.

BACKGROUND OF THE INVENTION

Mining operations, particularly those which take place near to the working face, tend to be carried out under conditions of restricted space and can be dangerous. It is important that, in such conditions, the miners operating mining machinery are provided with every assistance to ensure that their tasks are not made more difficult or hazardous than they need to be. One area of assistance that is a fact of modern mining operations is the increased mechanisation of the operations. Mining machines have been developed, for example semi-automated roof bolting machines, and these machines carry out roof bolting operations far more quickly and safely than would an individual miner using hand-held drilling equipment.

In order to operate machinery such as semi-automated roof bolting machines it is necessary to continuously supply the machines with stocks of parts and equipment necessary to carry out the operation. A roof bolting machine, for example, needs to be continuously supplied with roof bolts, washers, nuts and resin capsules as well as requiring fairly frequent replacement of drill rods and other consumables used on the machine. It is important that the operation of supplying such parts and equipment to the machine is carried out efficiently and it is desirable that such supply is carried out using mechanical assistance where possible. It is important that all items of equipment required on the machine are supplied in the correct proportions since if any one critical item of equipment is exhausted on the machine, the mining operation will need to be halted while that item of equipment is replenished.

SUMMARY OF THE INVENTION

According to the invention there is provided a storage pod for storing equipment and parts for use in underground mining operations, said storage pod being self supporting and removable from a transport or operational vehicle whereupon said pod is carried in use, said pod comprising a generally rectilinear body which forms an open topped upper compartment having a front wall, a rear wall, side walls and a floor, and a lower compartment located below said floor, said lower compartment being divided into a series of elongated storage slots, said slots being accessible from the front and/or rear of the pod.

The upper compartment of the storage pod may be divided into a series of smaller compartments by one or more internal partitions. Preferably there will be at least one internal partition which extends laterally at least part way across the width of the upper compartment adjacent to either the front wall or the rear wall. Optionally, there may be at least one longitudinally extending internal partition dividing at least part of the length of the upper compartment into two side by side longitudinally extending smaller compartments. Said longitudinally extending internal partition may be aligned at an angle to the centre line of the pod so that the two longitudinally extending smaller compartments formed thereby have a tapering shape in plan view. The longitudinally extending internal partition may terminate short of either or both the front wall and/or the rear wall. One or more of the internal partitions may be removably mounted within the upper compartment.

Either the front wall or the rear wall or both said walls may have a door formed therein which is openable to provide easier access to the interior of the compartment adjacent to said wall. Preferably the door is joined to the remainder of said wall by means of a hinge which has a generally horizontal pivot axis.

The elongated storage slots may be formed by a series of vertically extending, spaced apart, parallel ribs, which extend parallel to the centre line of the pod. Preferably a horizontal base plate extends below the elongated storage slots.

The pod may include a pair of longitudinally extending, parallel, spaced apart support channels located below the storage slots. The said support channels are preferably open at opposite ends thereof and are adapted to receive the tines of a forklift truck for lifting and maneuvering the pod. The pod may further include a pair of transversely extending slots in a side thereof adapted to receive the tines of a forklift truck from a position on either side of the pod.

The underside of the pod may include guide formations thereon adapted to co-act with cooperant guide formations on a vehicle which is adapted to carry the pod in use. The guide formations may facilitate the docking of the pod on the vehicle as the pod is positioned on the vehicle in use. Releasable locating means may be provided on the pod for locking the pod to a vehicle.

The invention extends to an underground mining machine in assembly with a pod of the type described above, the vehicle and pod having cooperating locking formations thereon for releasably locking the pod to the vehicle for the duration of a mining operation and adapted to allow removal of the pod from the vehicle and replacement thereof with another pod as and when required in use.

These and further features of the invention will be made apparent from the description of an embodiment thereof given below by way of example. In the description reference is made to the accompanying drawing but the specific features shown in the drawing should not be construed as limiting on the invention. In particular, the mining machine with which the invention may be used is but one example of the kind of mining machine with which the invention would be suitable for use.

When used in this specification, the term "comprises" or "comprising" should be interpreted inclusively rather than exhaustively or exclusively.

BRIEF DESCRIPTION OF THE DRAWINGS

Embodiments of the invention will now be described, by way of example only, with reference to the accompanying drawings in which.

DETAILED DESCRIPTION OF PREPARED EMBODIMENTS

Figure 1:
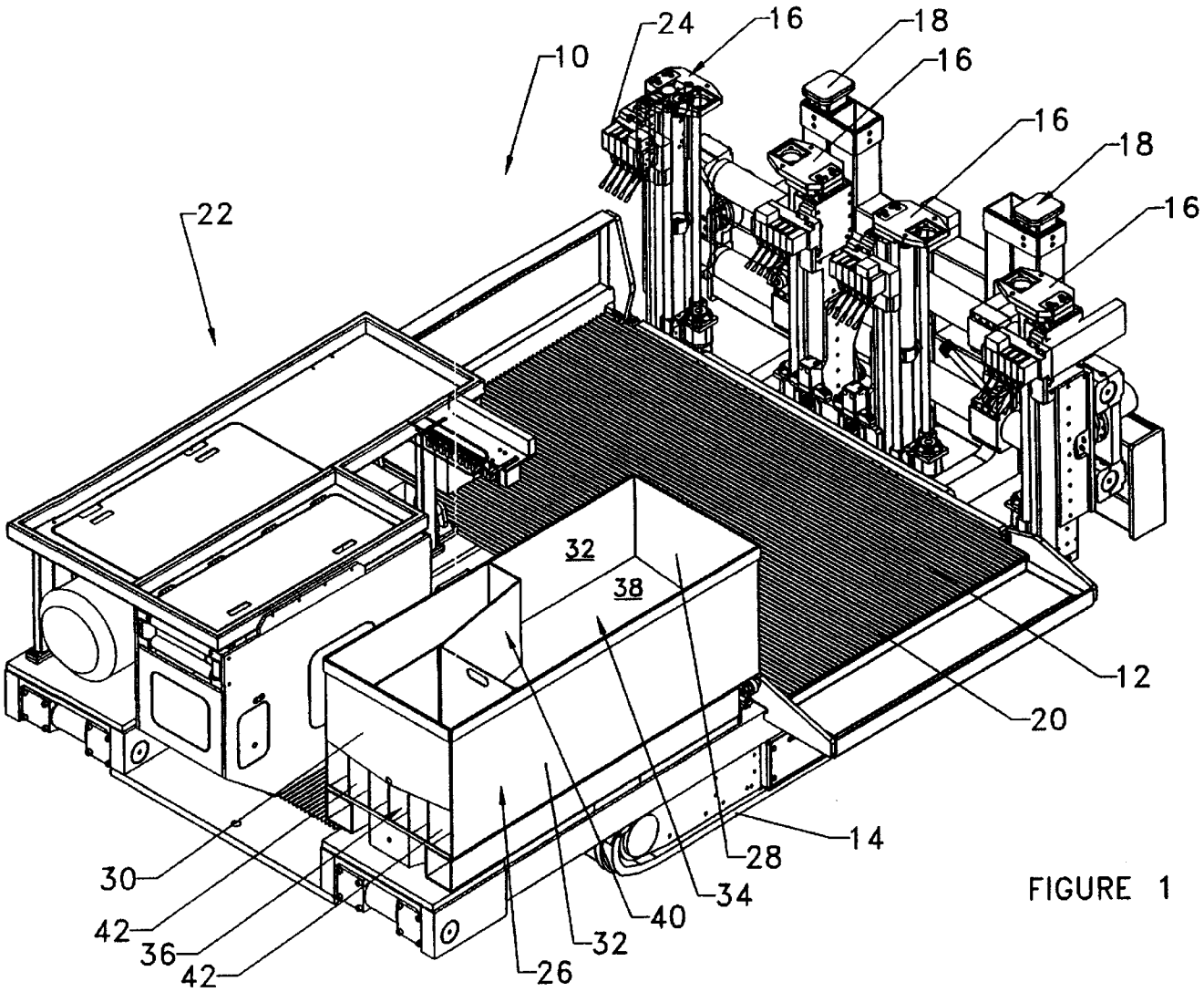
FIG. 1 shows a perspective view of a mining machine having a storage pod according to the invention mounted thereto.
Figure 2:
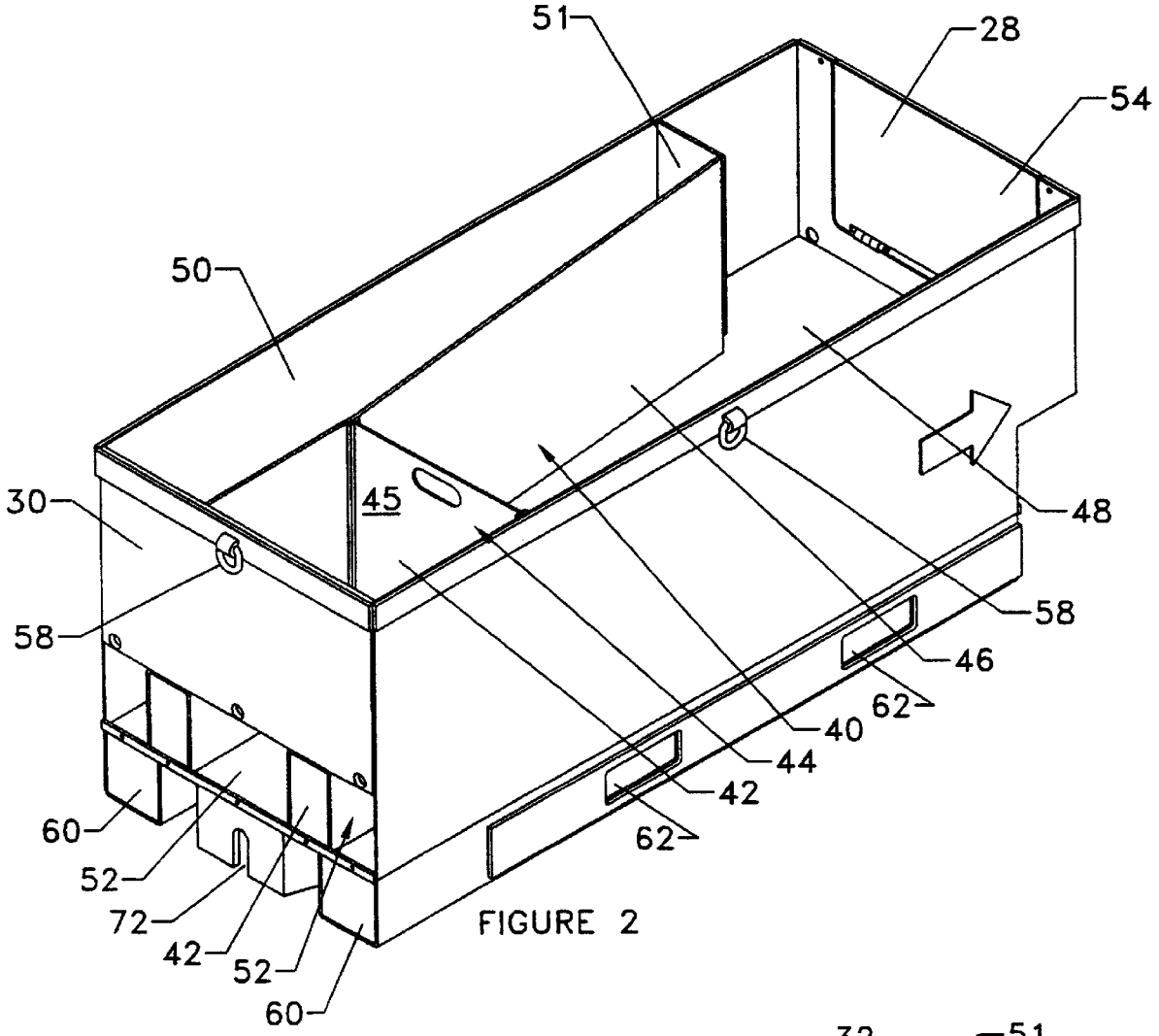
FIG. 2 shows a perspective view of a storage pod according to the invention.
Figure 3:
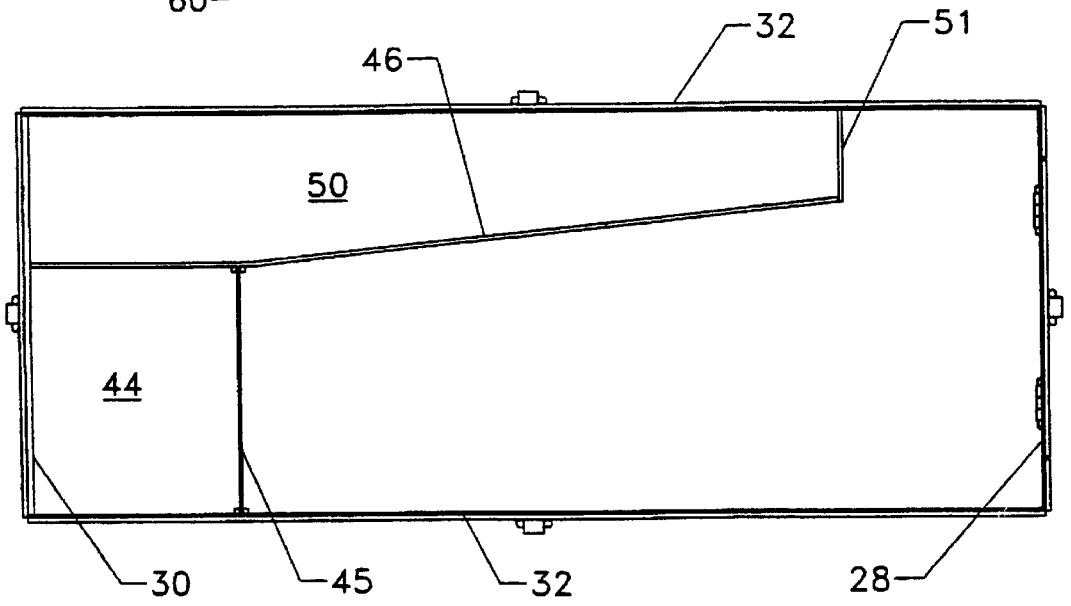
FIG. 3 shows a plan view of the storage pod shown in FIG. 2.
Figure 4:
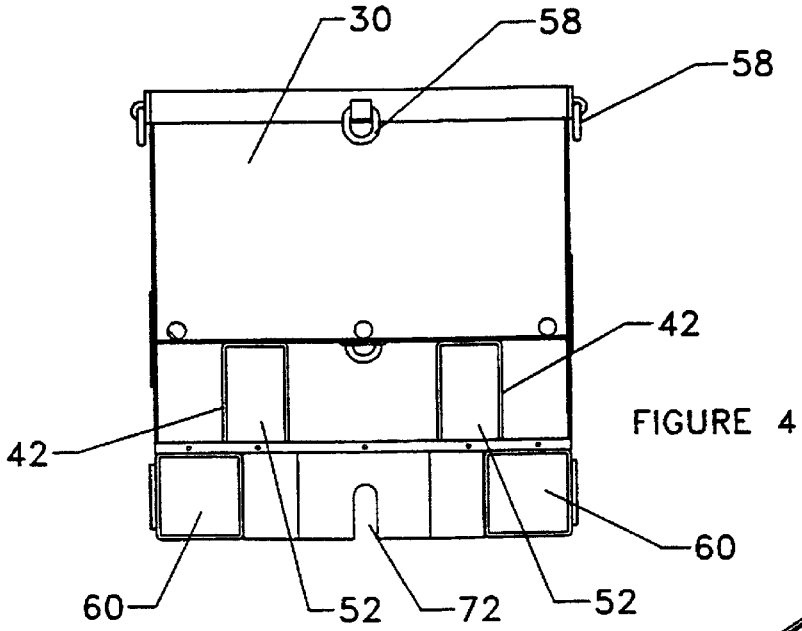
FIG. 4 shows a rear view of the storage pod shown in FIG. 2.

Referring initially to FIG. 1, an underground mining machine 10 comprises a generally planar platform 12 which is mounted on endless driven tracks 14 and which has a series of bolting rigs 16 on the forward end thereof for installing rib and roof bolts into a mine entry. A pair of extendable roof support members 18 are also mounted to the forward end of the machine for providing temporary roof support during the bolting operations and to stabilise the platform 12. A work area 20 is defined on the forward end of the platform 12 and drive motors and control apparatus indicated generally at numeral 22 are mounted towards the rear of the platform 12. It will be noted that for this particular machine there are four bolting rigs 16 each of which is independently operable by means of a control station 24 associated therewith.

It will be appreciated that the bolting rigs 16 will utilise significant numbers of bolts, nuts, washers and resin capsules during normal bolting operations. As the machine advances into a mine entry, bolts will normally be installed in a grid pattern and the bolts with typically be installed approximately 1.5 meters apart from each other. Installing roof bolts in this arrangement results in a high consumption of drill rods and utilises large numbers of bolts, nuts, washers and resin capsules. To ensure that there is no significant interruption in the bolting operation it is necessary to ensure that a stock of consumable items is maintained on the vehicle. It will be appreciated that such items are reasonably heavy and therefore supplying such items in large quantities usually requires the use of mechanised lifting equipment and powered supply vehicles.

The machine shown in FIG. 1 carries a removable storage pod 26 on the platform 12 towards the rear side thereof in which such consumables may be stored in individual compartments allocated to the different items. As shown, the storage pod 26 is of generally rectilinear configuration and is defined by a front wall 28, a rear wall 30 and side walls 32. The storage pod is divided into an upper compartment 34 and a lower compartment 36 by a floor 38. The floor 38 may have a shallow V-shaped configuration to limit the extent to which items may roll around within the upper compartment.

Internal partitions 40 divide up the upper compartment 34 into smaller compartments. This is discussed in more detail below. The lower compartment 36 is divided into a series of longitudinally extending parallel slots by a series of vertically extending ribs 42. The arrangements of the ribs 42 below the floor 38 ensures that the ribs provide added support for the floor 38.

The storage pod 26 is removably mounted to the platform 12 as will be described in more detail below.

Turning to FIGS. 2 to 5 of the drawings, the storage pod is shown in more detail. It will be noted that the upper compartment 34 is divided into three small sized compartments by the internal partitions 40. A small rectangular compartment 44 is formed in the rear of the upper compartment by a transverse wall 45 which is removably mounted within the upper compartment so that the small compartment 44 can be eliminated if it is not required.

A generally longitudinally extending partition 46 divides the compartment 34 lengthwise. This defines a major compartment 48 within which roof bolts may be located. It is envisaged that the rock bolts when they are in this compartment prior to use will have a nut on the end thereof so that one end of the rock bolt will be of larger dimension than the other end. The compartment 48 is wedged-shaped in plan view so that the larger dimensioned ends of the rock bolts could all be placed at the forward end of the storage pod and will therefore be accommodated in the wider part of the compartment 48, that is, the part adjacent to the front wall 28. A narrow compartment 50, which is formed on the opposite side of the partition 46, will be adapted to store elongated items such as drill rods or rib bolts. Clearly, the configuration of the internal partitions can be varied to suit the type of equipment that will be stored and transported in the storage pod. The end wall 51 of the compartment 50 may be removed where it is desired to make the compartment longer so as to be able to store rib bolts for example.

The lower compartment 36 is, as mentioned, divided into a series of slot-shaped smaller compartment 52 by the vertically extending ribs 42. It is envisaged that these rectangular slot 52 will be dimensional to receive boxes of resin capsules (not shown) lengthwise therein. It is envisaged that the boxes of capsules will be insertable into the slots 52 from either end of the storage pod and can, likewise, be removed from either end of the pod.

The front wall 28 and rear wall 30 each have a door numbered 54 and 56 respectively formed therein. The doors are hinged by their bottom edge so that they are able to flap downwardly and thereby provide easy access to the compartment adjacent thereto. The door 54 in the front wall 28 is a relatively wide configuration and the door 56 in the rear wall is far smaller since the compartment 42 is of a relatively small size.

Four lifting eyes 58 are provided on the storage pod for the purposes of lifting the storage pod as and when required.

The storage pod has a pair of longitudinally extending channels or skids 60 formed on the underside thereof which extend parallel to the centre line of the pod and extend between the front and rear of the pod. These channels 60 provide feet in which the storage pods rest on the platform 12 and also provide slots for receiving the tines of a forklift truck for the lifting and maneuvering of the storage pod. It will be appreciated that when the storage pod is filled with equipment and materials it will be relatively heavy and it will therefore require the use of some form of lifting apparatus in order to be moved around. A pair of laterally extending slots 62 are formed in the side of the storage pod so that the storage pod may be lifted from its side by means of a forklift truck if required.

Figure 6:
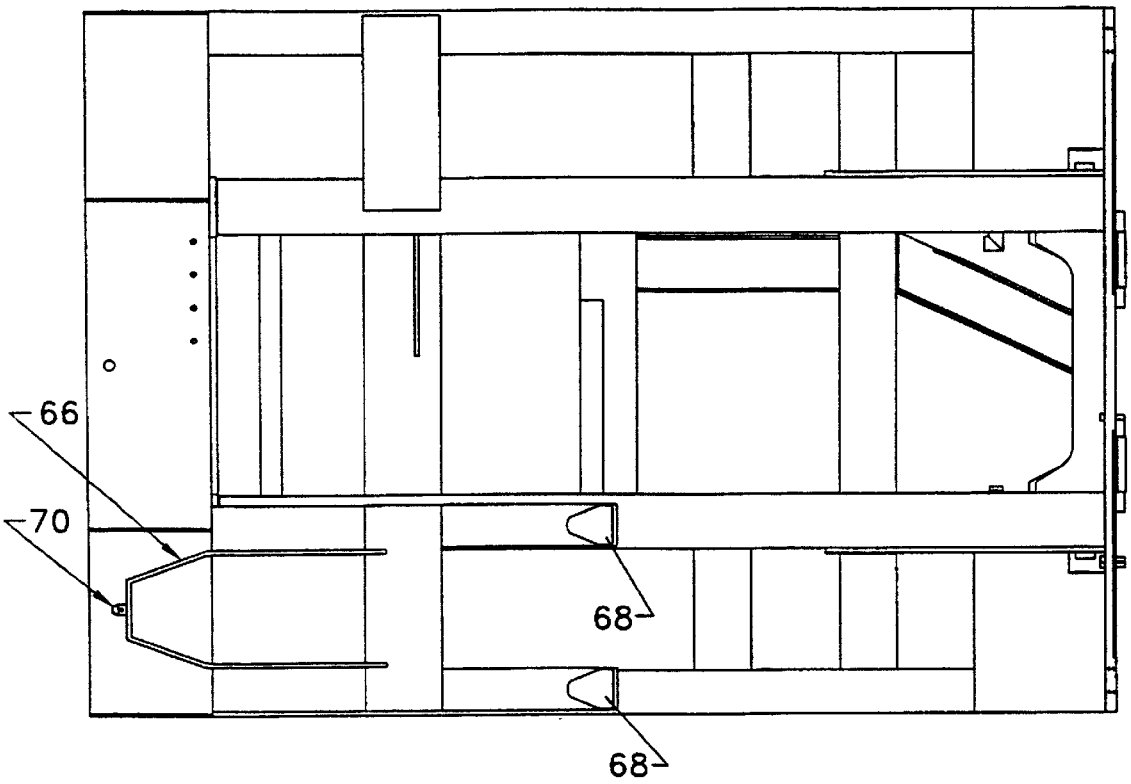
FIG. 6 shows a plan view of the frame of a vehicle to which a storage pod is to be mounted.
Figure 7:
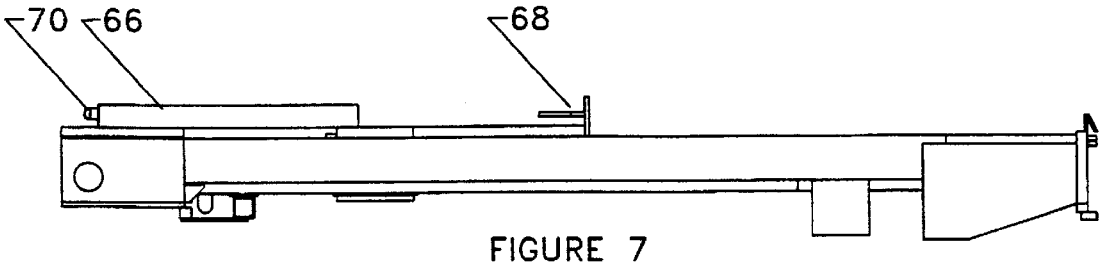
FIG. 7 shows a side view of the vehicle shown in FIG. 6.

The channels 60 also serve as skids on which the storage pod may be slid as it engages or docks with the mining machine 10. As is clear from FIGS. 6 and 7 of the drawings, the platform 12 has a pair of guides numbered 64 adapted to receive the channels 60 and thereby properly locate the storage pod on the platform. A shaped nose 66 will be used to guide the storage pod into the guides 64 during docking of the storage pod on the platform 12. The ends of the guides 64 each have a lug 68 mounted thereto which will engage within the channel 60 and thereby ensure that the pod is not able to lift away from the platform when it is properly docked onto the platform. The nose 66 has a lug 70 mounted thereto which is adapted to engage in an aperture 72 formed on the underside of the storage pod. When the lug 70 is located in that aperture 72, a pin may be inserted through a hole formed in the lug 70 to thereby lock the storage pod to the lug 70 and thereby ensure that the storage pod is not able to inadvertently slide off the back of the vehicle as the vehicle moves around or moves along an incline.

It will be appreciated that it will be a relatively simple operation to remove a pod from a vehicle and replace it with a replenished pod as and when the stocks of equipment and materials on the vehicle need replacing. Thus where the pod is used, as in this present example, to store equipment used in bolting operations each of the compartments may be filled with the correct numbers of bolts, nuts, washers and the like as well as the correct number of resin capsules and drill rods. It is envisaged that the series of pods will be located at an underground materials depot and underground workers at the depot will replenish the spare pods with materials and equipment. A forklift truck will travel between the materials depot and the mining machine to replace the storage pods as and when the materials and equipment are consumed on the machine. In this way, interruption to the mining operation should be minimised and also it will not be necessary to maintain a store of materials and equipment adjacent to the mining operation where such equipment and materials would be liable to be damaged and also tend to obstruct the mining operation.

Illustrated in FIGS. 8 to 12 is a second embodiment of the storage bin. In these figures is a track mounted rear pivoted bolter 2 similar to that of FIG. 1, which has two track units 4 and 6. The track units 4 and 6 have a relatively shallow track assembly height. The track units 4 and 6 are each independently linked to a platform assembly 8 and are not constructed as part of a chassis to form a rigid undercarriage.

The bolter 2 as illustrated in each of FIGS. 8 to 11 includes two materials pods 46 and 48 mounted on the rear of the platform assembly 8, in a raised location. As will be seen in FIG. 4, the maximum height of the pods 46 and 48 is below the top plates 141 of the timber jacks of the bolting rigs 140,142, 144,146. The frames holding the pods 46 and 48 are made of angle iron posts 400, as will be described later. These frames are more clearly illustrated in FIGS. 5 and 6, which have the pods 46 and 48 removed.

Under the pod 46 is located a power pack 42, and adjacent thereto, but not under the pod 46, is a modular cable reel assembly 44. Housed under the location of the pod 48 is a circuit breaker box and master station 49 for the electronic control systems.

Located between the pods 46 and 48 is a station 990 for the operators to control and drive the bolter 2 moves from location to location. The station 990 can also include the controls to tilt the platform assembly 8 relative to the track units 4 and 6. If desired the station 990 can include a canopy, (as illustrated in FIGS. 39 to 43) to protect the operators while the bolter 2 is moving in a mine entry.

The platform assembly 8 is preferably of a length which is significantly greater than the maximum lift height at the front of the platform. This feature helps to limit the amount of rotation away from the vertical that the bolting rigs go through at the front of the platform assembly 8 due to the platform assembly 8 rotating relative to the track units 4, 6.

Figure 11:
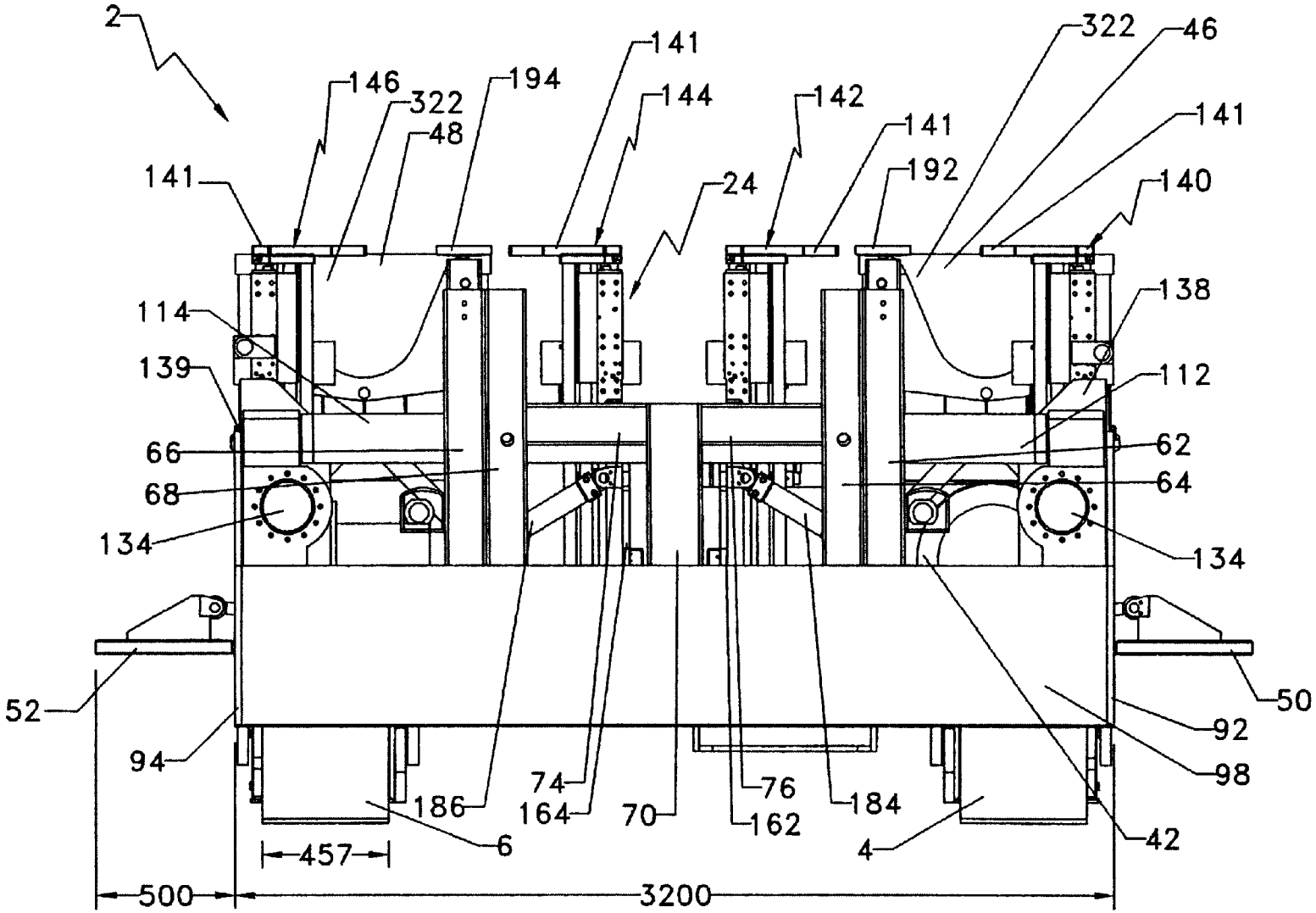
FIG. 11 illustrates a rear elevation of FIG. 1.
Figure 12:
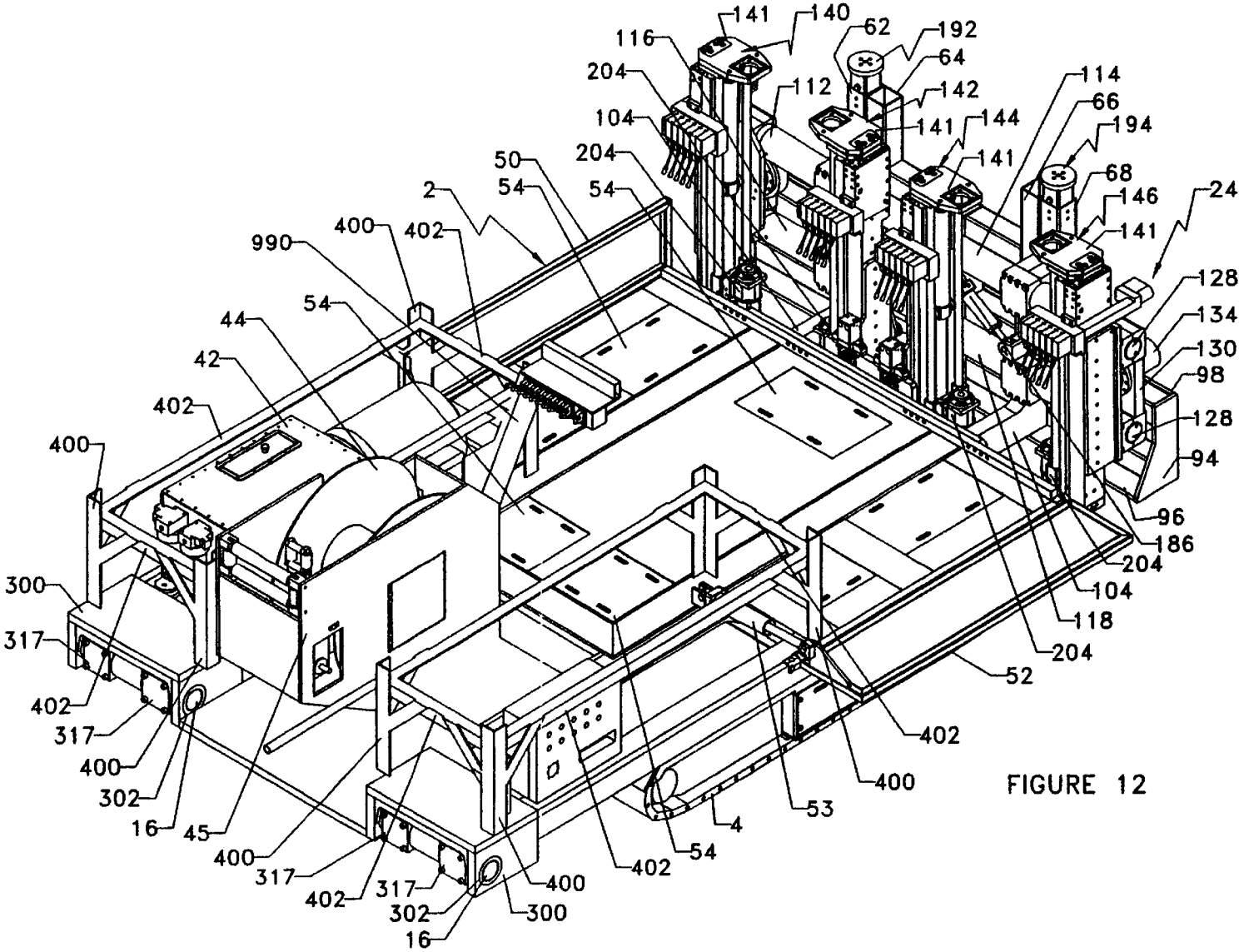
FIG. 12 illustrates a perspective view of the apparatus of FIG. 1 with material pods removed.

In FIG. 11 it will be noticed that fold down platforms 50 and 52 extend some 500 mm out from the side of platform assembly 8.

Figure 8:
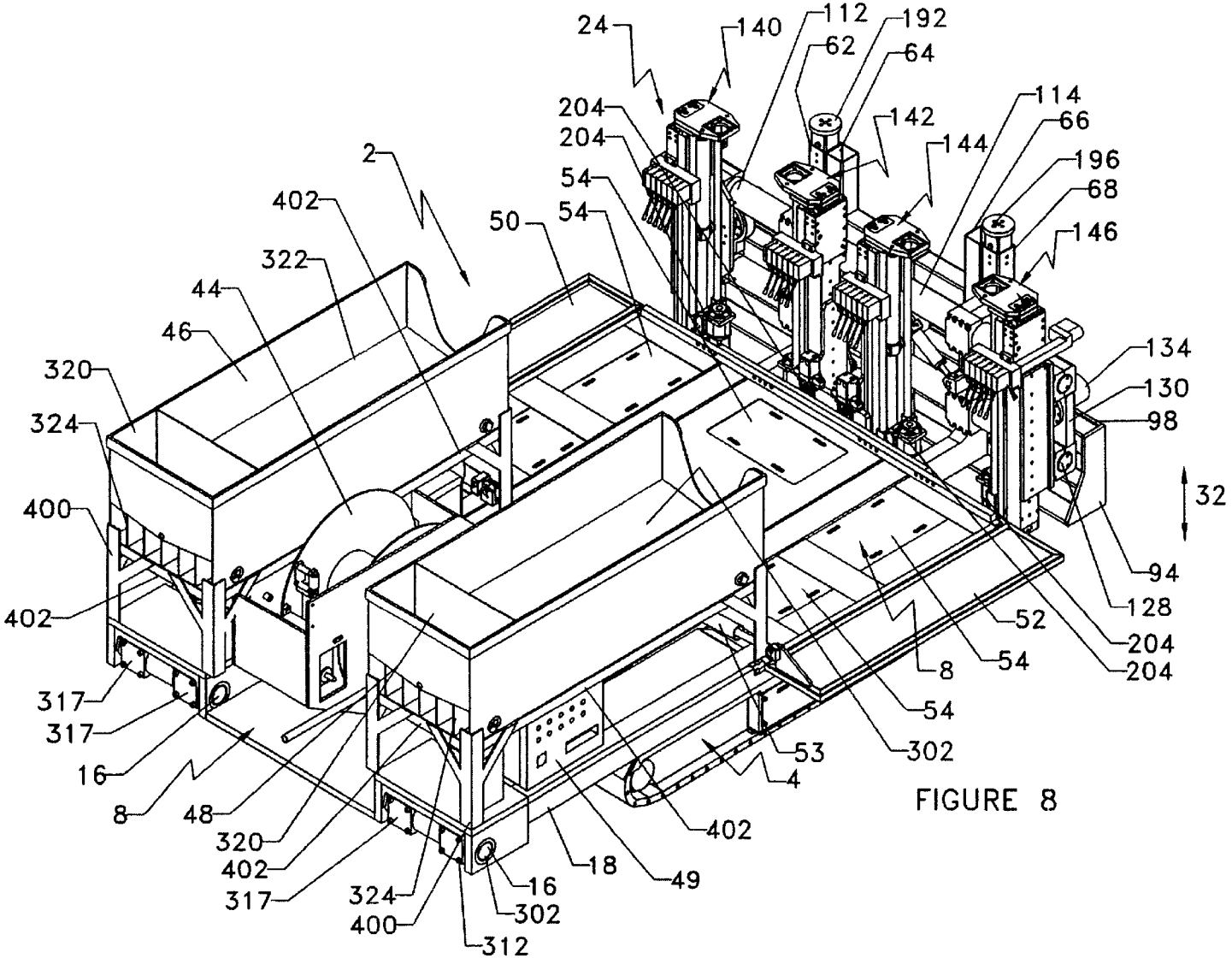
FIG. 8 illustrates a perspective view of a fully assembled mobile, pivoted platform bolting apparatus.
Figure 9:
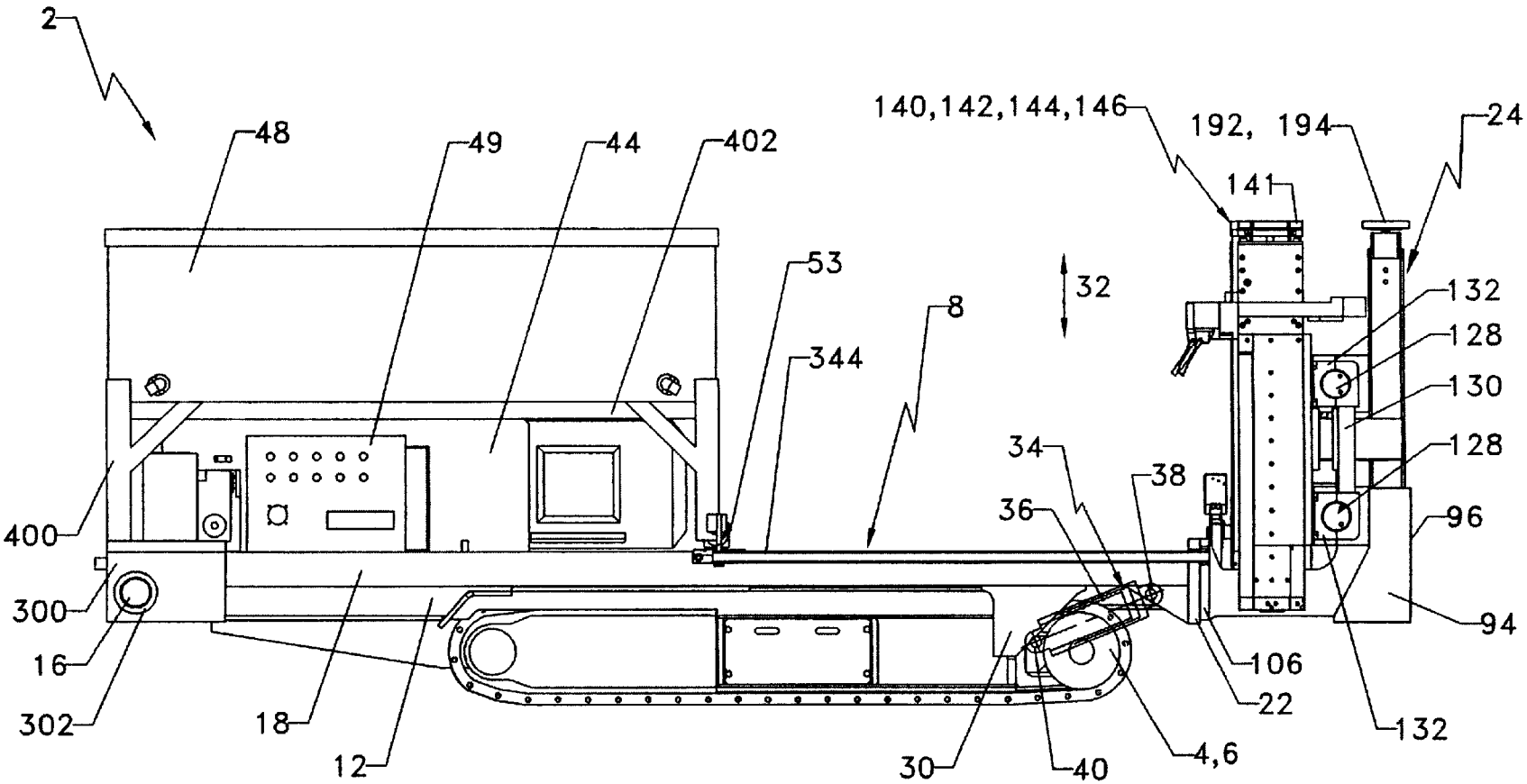
FIG. 9 illustrates a right side elevation of FIG. 1.
Figure 10:
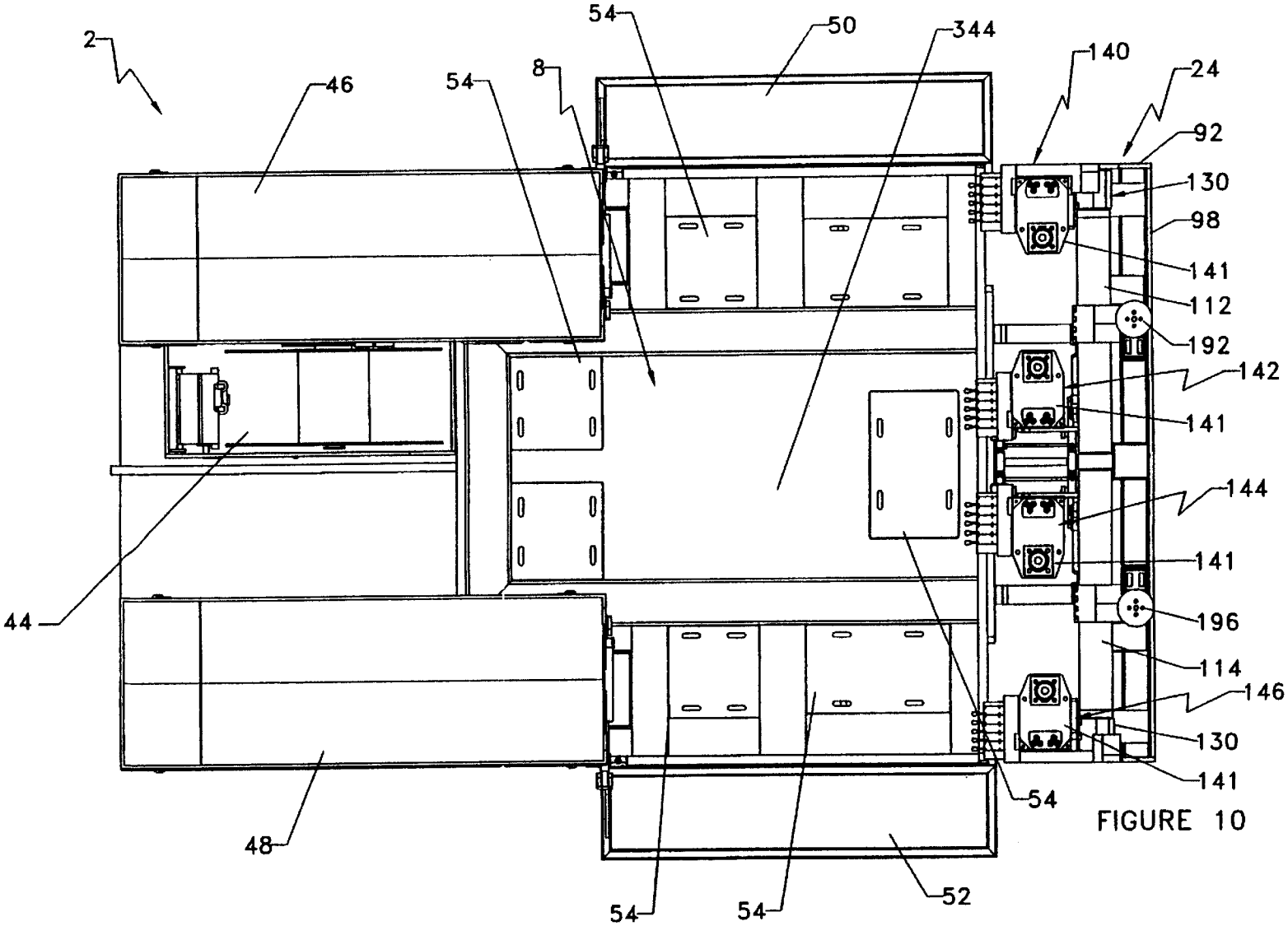
FIG. 10 illustrates a plan view of FIG. 1.

Illustrated in FIGS. 8 and 9, track units 4 and 6 have at their respective rear ends 10, a rearwardly and upwardly extending beam 12 which is secured to the top of the structure which forms the track units 4 and 6. At the rear end of each of the beams 12 is held a cylindrical pivot bar 16. The pivot bars 16 on each track unit rotatably connect to the platform assembly 8.

Each beam 12 is a fabricated beam which terminates with a mounting block 317 attached by welding to the termini of the beam 12. The mounting blocks 317 each have a semi cylindrical formation in a rearwardly projecting face. This semi cylindrical formation receives half of the outside diameter of the pivot bar 16. The pivot bar 16 is firmly clamped into place between the mounting block 17 and mating clamping blocks which also include a semi-cylindrical formation. The mounting blocks 317 and mating clamping blocks are secured together to clamp the pivot bar 16 therebetween by means of four machine screws 312.

Positioned above the power pack 42, as illustrated in the FIGS. 8 to 11 is the material pod 46 which houses a supply of consumables such as resin, bolts, and plates for the operator to use in the bolting process. The pod 46 is illustrated in greater detail in FIG. 27.

Figure 13:
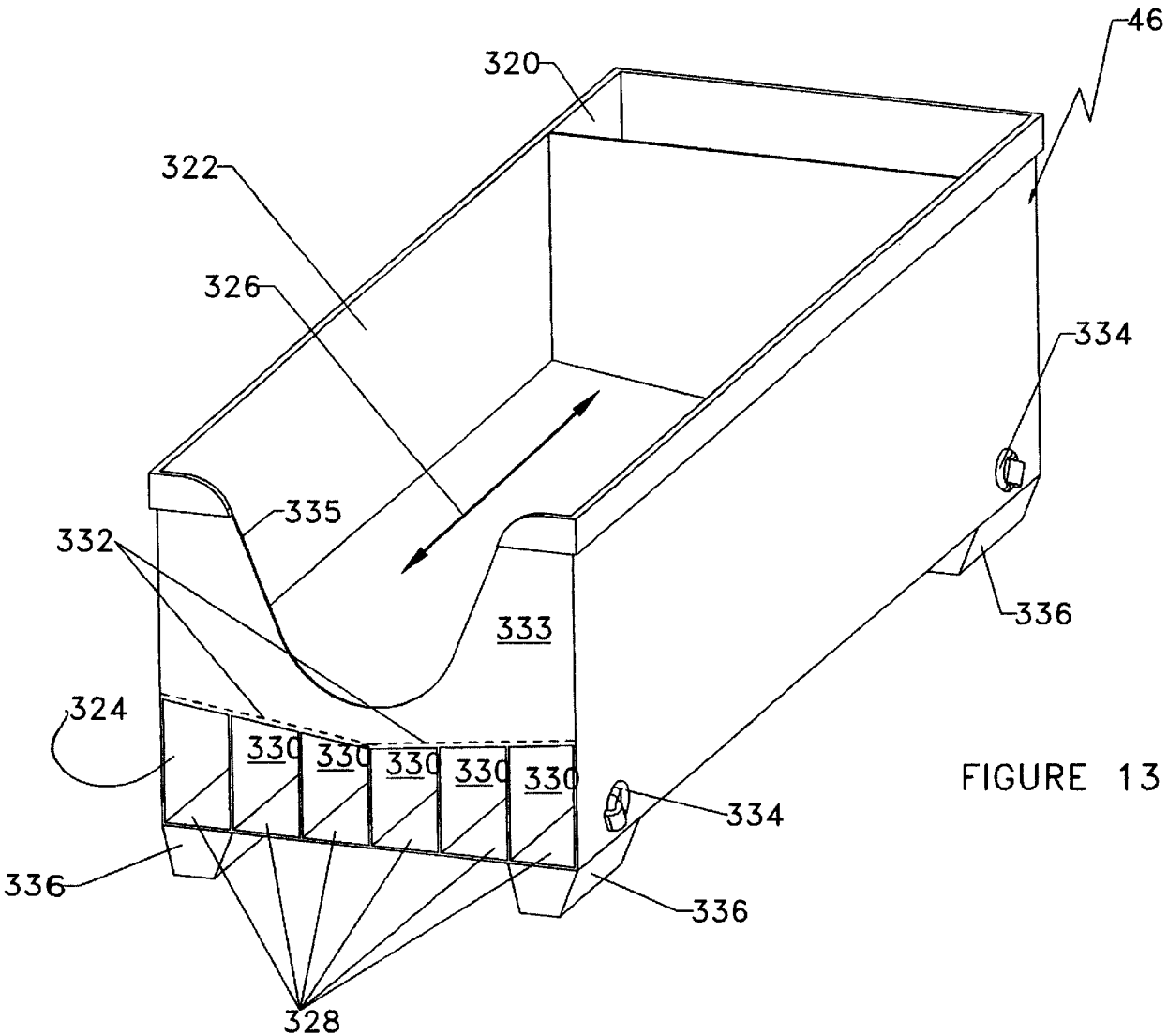
FIG. 13 illustrates a perspective view of a materials pod for use with the bolter of FIG. 1

As illustrated in FIG. 13, the pod 46 is divided into 3 general compartment areas. The first compartment 320 occupying the rear of the pod 46, is of an open box shape and is used to store drilled plates for assembly onto the threaded ends of bolts. The compartment 320 has a depth equal to the depth of a second compartment 322.

The second compartment 322, is the largest compartment on the pod 46, to receive tendons or bolts. When the bolts are placed in compartment 322, they are oriented so that their longitudinal axis is parallel to arrows 326. The base of compartment 322 has a converging base 332, so as to direct the bolts in the bottom of the compartment 322 towards the centre. This helps to prevent movement of the bolts once located therein. The compartment 322 is preferably of a length to receive 2.1 m length bolts. The compartment 322 is also of a depth and width to allow the compartment 322 to receive approximately 200 bolts. The front wall 333 of the second compartment 322, has a deep cut out 335, which is of a width and depth to allow an operator to gain unobstructed entry, so as to remove bolts from inside the compartments.

A third compartment 324 is of the same length as the pod 46 and is provided with as a series of six full length cavities 328. The walls 330 between each cavity 328 provide columns the length of the pod 46, to support the base 332 of the compartment 324.

The six cavities 328 receive tubes or capsules or unmixed resin for insertion into a bored hole in mine strata to set a bolt therein.

Retractable lifting lugs 334 are present on the outside of the pod 46 to facilitate lifting.

Figure 5:
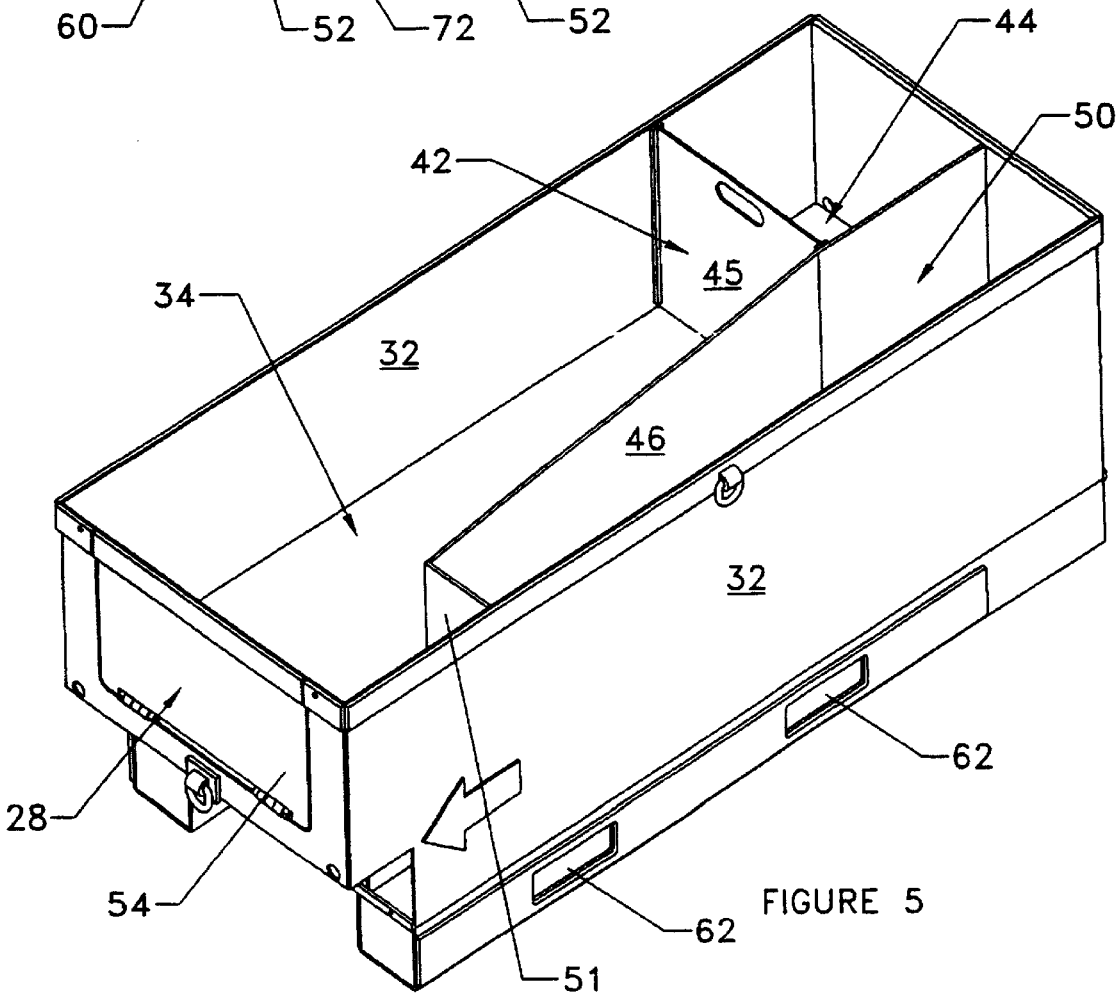
FIG. 5 shows a front perspective view of the storage pod shown in FIG. 2.

The pod 46 includes four feet 336 which have an inverted truncated pyramidal shape. Four angle iron posts 400, mounted on the platform assembly 8, receive the feet 336. The tops of the posts 400 are positioned so as to provide an opening with a length and width greater than the length and width respectively of the pod 46 (as illustrated in FIGS. 1 to 9). As the base of the feet 336 lie at the end of four converging or inwardly tapering sides, the base of the feet 336 will have a rectangular dimension some 50 mm on each side less than the rectangular dimensions of the top of the feet. By such tapered feet, an LHD (Load Haul Dump) will only need to align the pod 46 into a position within 100 mm of the sides of its final location. With this done, by lowering the pod 46, the weight of the pod 46 will centre each of the feet 336 into the posts 400 on the platform assembly 8. Once inside of the posts 40, the weight of the pod 46 is carried by the horizontal members 402 as illustrated in FIG. 5.

The pod 46 includes sufficient volumes in the compartments 320, 322 and 324 so as to carry approximately 200 bolts with nuts attached, 200 resin sausages, and 200 plates in each of the respective compartments.

When an operator has run out of bolts from pod 46, the whole pod 46 can be removed from the vehicle and replaced with a replenished pod. A second pod 48 of the same construction as pod 46 is positioned over the rear right side of the bolter 2. The pod 48 can be for the second operator on the right side of the vehicle to access or alternatively each operator takes from one pod so that when that one pod is emptied it can be replaced with a replenished pod, while the operators take consumables from the other pod. This ensures that no break in bolting need occur during replenishment of stock of consumables on the roof bolter.

While the above description refers to bolting rigs, the rigs may be used for coring, or drilling purposes along, without installation of bolts.

Further, the bolting rigs described above are referred to as having rotational units, but such units may be percussive alone, or a combination of rotational and percussive units.

While one of the main features disclosed in the above description is the provision of a platform assembly pivoted at the rear, and while this feature does provide many advantages, it can be replaced by other mechanisms for lifting, such as the pantographic type, scissor type, or direct hydraulic lift. However, with the pantographic or scissor types, as the platform assembly will remain parallel to the track units, additional inbye and outbye tilting may be needed on the central bolting rigs. Without a pivoted connection, leveling of each individual rig would need to occur. On the other hand one advantage of using four direct hydraulic lifting units at four locations on the platform a variety of pitch and yaw angles could be achieved.

In all of the above described embodiments, the bolting rigs 140, 142, 144 and 146 are preferably of the sort as disclosed in pending Australian patent application 34200/97 which is to be published on or about Feb. 8, 1998, or corresponding application U.S. Ser. No. 08/908464. The rigs disclosed in these documents are preferred as they offer significant advantages compared to other bolting rigs. However, it will be understood that any appropriate bolting rig could be utilised with the embodiments of this invention.

As previously mentioned, the invention is not limited to the shape or configuration of storage pod as depicted in this embodiment. Where the mining machine was used, for example, for installing mine props or the like, it may be advantageous to have a completely different form of storage pod which would be more suited to that type of operation. Likewise, for machinery used for cutting or scraping or any other similar mining operation the storage pod may well be used to store other parts and equipment more suited for that type of operation.

What is claimed is:

1. A storage pod for storing equipment and parts for use in underground mining operations, said storage pod being self supporting and removable from a transport or operational vehicle whereupon said pod is carried in use, said pod comprising a generally rectilinear body which forms an open topped upper compartment having a front wall, a rear wall, side walls and a floor, and a lower compartment located below said floor, said lower compartment being divided into a series of elongated storage slots, said slots being accessible from the front and/or rear of the pod.

2. A storage pod as claimed in claim 1, wherein said upper compartment of the storage pod is divided into a series of smaller compartments by one or more internal partitions.

3. A storage pod as claimed in claim 1, wherein there is at least one internal partition which extends laterally at least part way across the width of the upper compartment adjacent to one of the front wall or, the rear wall.

4. A storage pod as claimed in claim 1, wherein there is at least one longitudinally extending internal partition dividing at least part of the length of the upper compartment into two side by side longitudinally extending smaller compartments.

5. A storage pod as claimed in claim 4, wherein said longitudinally extending internal partition is aligned at an angle to the centre line of the pod so that the two longitudinally extending smaller compartments formed thereby have a tapering shape in plan view.

6. A storage pod as claimed in claim 4, wherein said longitudinally extending internal partition terminates short one of the front wall or the rear wall.

7. A storage pod as claimed in claim 1, wherein one or more of said internal partitions are removably mounted within the upper compartment.

8. A storage pod as claimed in claim 1, wherein either the front wall or the rear wall or both said walls may have a door formed therein which is openable to provide easier access to the interior of the compartment adjacent to said wall.

9. A storage pod as claimed in claim 8, wherein said door or doors is or are joined to the remainder of said wall by means of a hinge which has a generally horizontal pivot axis.

10. A storage pod as claimed in claim 1, wherein elongated storage slots are formed by a series of vertically extending, spaced apart, parallel ribs, which extend parallel to the centre line of the pod.

11. A storage pod as claimed in claim 1, wherein a horizontal base plate extends below the elongated storage slots.

12. A storage pod as claimed in claim 1, further including a pair of longitudinally extending, parallel, spaced apart support channels located below the storage slots.

13. A storage pod as claimed in claim 12, wherein said support channels are preferably open at opposite ends thereof and are adapted to receive the tines of a forklift truck for lifting and maneuvering the pod.

14. A storage pod as claimed in claim 1, wherein said pod further includes a pair of transversely extending slots in a side thereof adapted to receive the tines of a forklift truck from a position on either side of the pod.

15. A storage pod as claimed in any one of claims 1 to 14, wherein the underside of said pod may include guide formations thereon adapted to co-act with cooperant guide formations on a vehicle which is adapted to carry the pod in use.

16. A storage pod as claimed in claims 15, wherein said guide formations facilitate the docking of the pod on the vehicle as the pod is positioned on the vehicle in use. Releasable locating means may be provided on the pod for locking the pod to a vehicle.

17. An underground mining machine in assembly with a pod as claimed in any one of claims 1 to 16, wherein said machine and said pod having cooperating locking formations thereon for releasably locking the pod to the vehicle for the duration of a mining operation and adapted to allow removal of the pod from the machine and replacement thereof with another pod as and when required in use.

* * * * *